US006723025B2

(12) United States Patent
Rayho

(10) Patent No.: US 6,723,025 B2
(45) Date of Patent: Apr. 20, 2004

(54) CHILDREN'S SPACE POD MODULE ASSEMBLY

(76) Inventor: Ronald F. Rayho, 117 Mary Lee Dr., Seymour, TN (US) 37865-5631

( * ) Notice: Subject to any disclaimer, the term of this patent is extended or adjusted under 35 U.S.C. 154(b) by 295 days.

(21) Appl. No.: 09/756,837

(22) Filed: Jan. 9, 2001

(65) Prior Publication Data

US 2002/0160885 A1 Oct. 31, 2002

(51) Int. Cl.[7] ..... A63B 9/00
(52) U.S. Cl. ..... 482/35; 472/136
(58) Field of Search ..... 462/35, 36; 52/6, 52/7; 446/82, 423, 476, 71–73; 472/116, 118, 135, 136

(56) References Cited

U.S. PATENT DOCUMENTS 2,765,544 A * 10/1956 Neveroksi, Jr. ..... 434/72
5,205,748 A * 4/1993 Petersheim ..... 434/258
5,326,328 A * 7/1994 Robinson ..... 472/136
5,387,165 A * 2/1995 Warren ..... 482/35
5,669,855 A * 9/1997 Dunn et al. ..... 482/35
5,733,165 A * 3/1998 Kelley ..... 446/73
5,913,750 A * 6/1999 Smithback ..... 482/54
6,419,587 B1 * 7/2002 Geyer ..... 472/116

* cited by examiner

*Primary Examiner*—Nicholas D. Lucchesi
*Assistant Examiner*—Fenn Mathew
(74) *Attorney, Agent, or Firm*—M. Alex Brown, Esq.

(57) ABSTRACT

A space pod and space saucer module assembly, for children's use and recreational enjoyment, is disclosed, which can be utilized solely or in interaction with another children's playhouse or structure. In preferred embodiments, a truncate or cross-sectionally accessible enclosure is provided having an elevated base support. The wall, floor and roof of the invention's enclosure have optionable, light-transmitting or see-through characteristics; and also provide an interior recreational play area inside the enclosure and optionable space-vehicle, simulating furnishings, such as control panel and seating. The assembly can be utilized with coupling members, for attachment to a neighboring structure, and for attachment to and additional support of its own guide support. A coupled or secured pathway or stairway structure is also provided in preferred embodiment for entrance to the play area of the invention's recreational-play enclosure.

21 Claims, 8 Drawing Sheets

CHILDREN'S SPACE POD MODULE ASSEMBLY

BACKGROUND OF THE INVENTION

1. Field of the Invention

The present invention relates to apparatus, methods and system for providing a children's play house, module enclosure, simulating a spaceship-type environment for children's recreational play.

2. Background Information

Although no references were found specifically relating to the present invention, those references typical of other somewhat or marginally related prior art references relating to children's recreational play areas, or similar structures, found during a search, include the following United States Patents: LaCrome et al., Des. 263,487; Teng, Des. Pat. No. 397,524; Kelly, Des. Pat. No. 376,404; Petersheim, Des. Pat. No. 340,098; Terrazas et al., Des. Pat. No. 327,922; Mercer, Des. Pat. No. 303,280; Mercer, Des. Pat. No. 302,198; Cavnar, Des. Pat. No. 280,999; Pavone, Des. Pat. No. 258,745; Vinson, U.S. Pat. No. 4,262,900; Rodriguez-Ferre, U.S. Pat. No. 5,819,479; Myszka et al., U.S. Pat. No. 5,816,980; Jaeb, Des. Pat. No. 377,203; Ezell, Des. Pat. No. 340,273; Mariol, Des. U.S. Pat. No. 322,101; Orenstein, Des. Pat. No. 287,740; and Gordon, Des. Pat. No. 274,450. Also located was an advertising brochure, setting forth various children's play houses and slides, and swing structures; vastly different, structurally from the present invention, but which, in some cases, could serve as a neighboring structure with which the present invention could interface; or adjoin in functional combination therewith. The advertising publication was issued in 1999 by Swing-N-Slide®.

More specifically, of those references cited above, having minor or marginal relativeness with regard to the present invention; the LaCrome design reference, '487, entitled, "Simulative Playhouse Or Similar Article," shows a non-saucer (non-space pod), space ship play house, having very substantially different configuration and structure in relation to the present invention; and having no means or structure for elevated support thereof.

The Teng '524 and Petersheim '098 references show a pet playhouse and playhouse, respectively, having some or partial circular configuration, without truncation; and, otherwise, of vastly different configuration, structure and functional simulated environmental effect with regard to a children's recreational play area.

Several of the other references, cited above, found; including Mercer '280, Mercer '198, Cavnar '999, Vinson '900, Myszka '980, Jaeb '203, Ezell '273, Mariol '101, Orenstein '740 and Gordon '450; show certain elevated areas connected by stairs, ladder or slide members; but which, otherwise, set forth vastly different configurations, structure and functional simulated effect in relation to the present invention.

None of the references found in the prior art specifically illustrate or disclose the Children's Space Pod Module Assembly of the present invention. Nor is the invention obvious in view of any of the prior art references listed. In addition all of the relevant prior art heretofore known suffer from a number of disadvantages.

None of the apparently crowded, prior art references found teach a children's playhouse module, or add-on assembly, which provides a cross-sectional, or truncated, recreational environment, simulating a saucer or space pod enclosure.

The prior art also suffers in that an elevated playhouse, simulating a saucer enclosure with a control panel and seating, is not provided for children's recreational purposes.

Also, none of the prior art references provide a playhouse simulating a saucer or space pod which can be utilized in combination with another type of playhouse or children's recreational structure.

The prior art also suffers in being complex in structural makeup, or requiring many parts for purposes of construction or installation.

These and other disadvantages, structurally and functionally, of the prior art will become apparent in reviewing the remainder of the present specification, claims and drawings.

Accordingly, it is an object of the present invention to provide an elevated saucer or space pod, for children's recreational purposes, which simulates a space saucer or pod environment and provides an enclosure where children can play under such a simulated environment. Also, in preferred embodiments, it is an object of the present invention, through positioned windows, or like transparent sections, placed peripherally; and enclosed, interiorly installed, furnishings and seating; to further simulate a saucer or space pod cockpit environment.

It is a further object of the present invention to provide a saucer-like, children's recreational playhouse which can be stabilized and interfaced in combination with other types of children's playhouses and elevated recreational children's structures.

If is a further object of the present invention to provide a relatively simple, and easy to manufacture, space pod or saucer enclosure which can be utilized by itself as a sole recreational structure.

It will, therefore, be understood that substantial and distinguishable structural and functional advantages are realized in the present invention over the prior art devices; and that the present invention's simplicity of structure, diverse utility, and broad functional applications serve as important bases of novelty and distinction in this regard.

SUMMARY OF THE INVENTION

The foregoing and other objects of the invention can be achieved with the present invention, device and assembly which is a space pod module assembly for use in a children's play-recreational area. The invention is provided with a saucer enclosure subassembly, truncate in configuration, having floor and roof segments and a curvilinear wall for support, positioned between these segments. The floor and roof segments and the supporting curvilinear wall are each provided with inboard and outboard surfaces. The inboard surfaces face toward the interior of the space pod module assembly. The curvilinear wall is provided with a middle portion, and first and second end portions. Each of the first and second end portions are greater in lengthwise dimension than the lengthwise dimension of the middle portion of the curvilinear wall. The saucer enclosure is also provided with, and defines, a recreational play area, inside the enclosure, adjacent to the inboard surfaces of the floor and roof segments, and the curvilinear wall, and opening at the first and second end portions of the curvilinear wall.

The space pod module assembly is also provided with a base securement subassembly having first and second ends and a peripheral side wall connected to the ends. The first end of the base securement subassembly of the invention is securely attached to the floor segment of the saucer enclosure subassembly, for support of the floor segment and the space pod module assembly as a whole. The second end is secured in relation to a surface or ground area of a children's play-recreational area, so that the saucer enclosure subassembly is safely secured for use.

REFERENCE NUMBERS IN DRAWINGS

Figure 1:
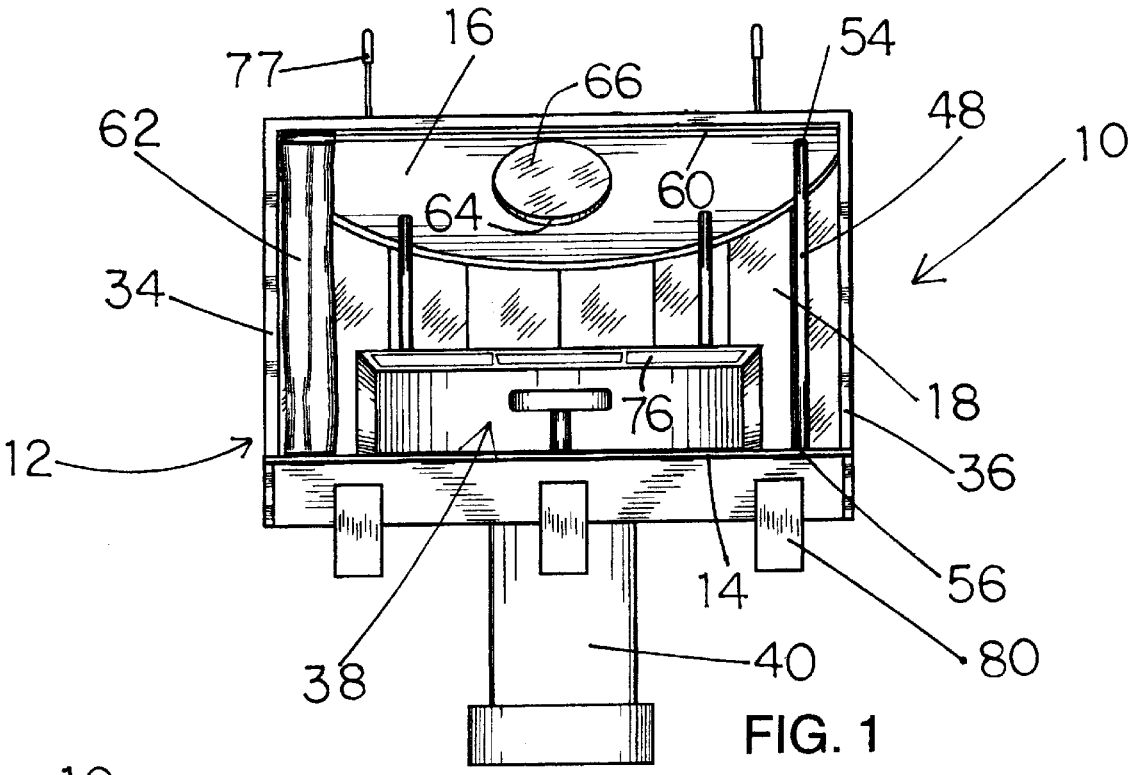
FIG. 1 is a front perspective view of one preferred embodiment of the novel children's space pod module assembly of the present invention, showing the curtain means of the invention, in an open position.
Figure 2:
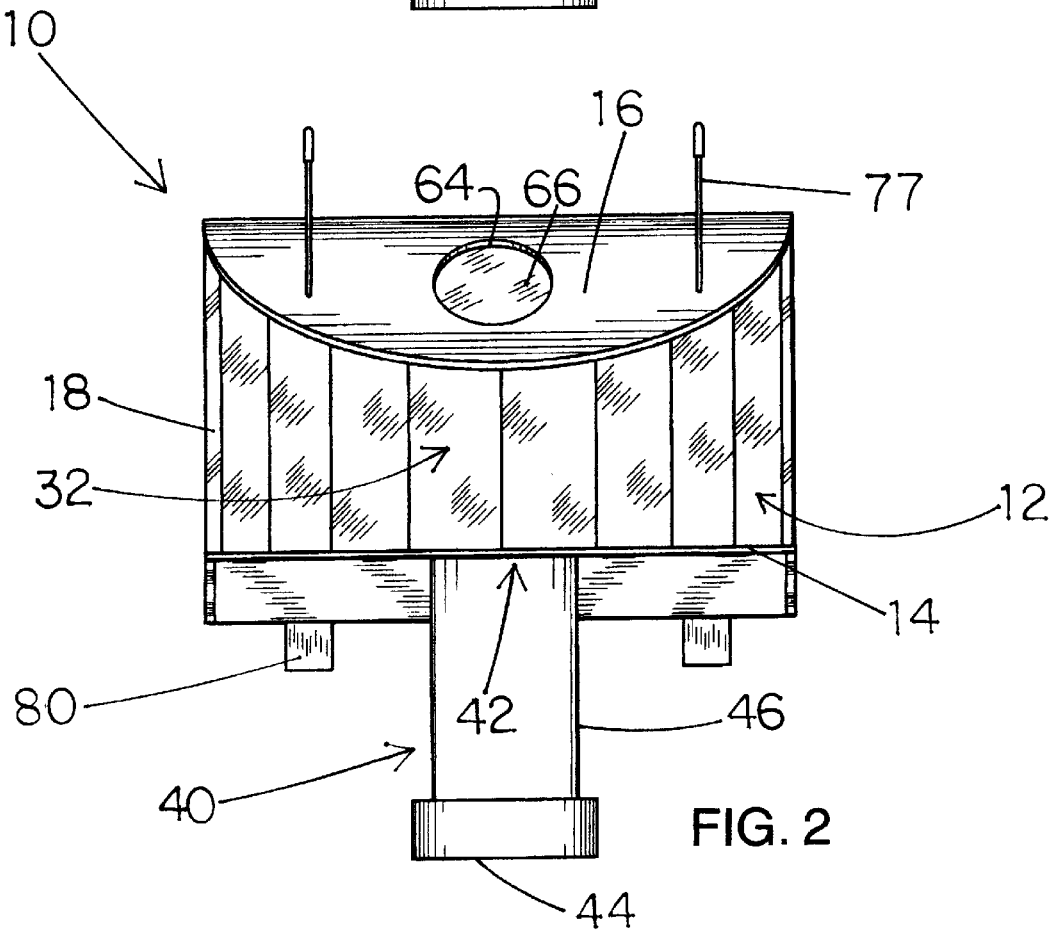
FIG. 2 is a back perspective view of the invention of FIG. 1.
Figure 3:
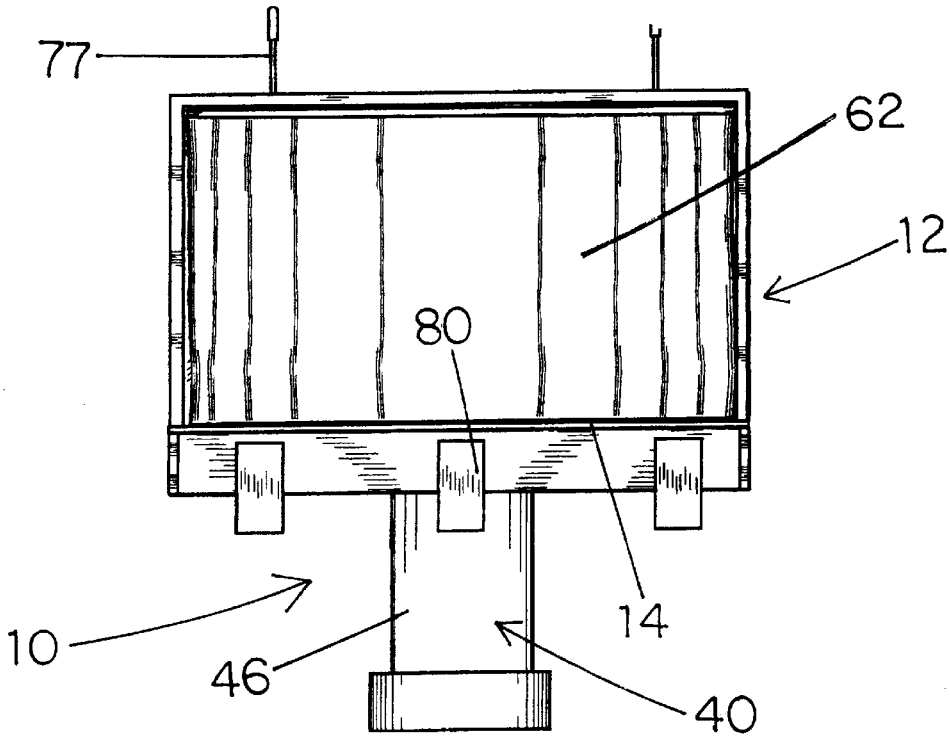
FIG. 3 is a front perspective view of the invention of FIG. 1, showing the curtain means of one preferred embodiment of the invention, in closed position, sealing off the interior play area of the invention.

| REFERENCE NUMBERS IN DRAWINGS | |
|---|---|
| 10 | Children's Space Pod Module Assembly or "Module" |
| 12 | saucer enclosure subassembly |
| 14 | floor segment of (12) |
| 16 | roof segment of (12) |
| 18 | curvilinear wall of (12) |
| 20 | inboard surface of (14) |
| 22 | outboard surface of (14) |
| 24 | inboard surface of (16) |
| 26 | outboard surface of (16) |
| 28 | inboard surface of (18) |
| 30 | outboard surface of (18) |
| 32 | middle portion of (18) |
| 34 | first end portion of (18) |
| 36 | second end portion of (18) |
| 38 | play area of (12) |
| 40 | base securement subassembly |
| 42 | first end of (40) |
| 44 | second end of (40) |
| 46 | peripheral side wall of (40) |
| 48 | support members of (12) |
| 50 | extended portion of (14) |
| 52 | extended portion of (16) |
| 54 | first end of (48) |

-continued

| REFERENCE NUMBERS IN DRAWINGS | |
|---|---|
| 56 | second end of (48) |
| 58 | peripheral wall of (48) |
| 60 | curtain rod member |
| 62 | curtain member |
| 64 | skylight space |
| 66 | light transmitting subportion |
| 68 | view space of (18) |
| 70 | see-through portion of (18) |
| 72 | air vent spaces of (14) |
| 74 | air vent grill members of (14) |
| 76 | simulating control panel of (12) |
| 78 | seating apparatus |
| 80 | coupling members |
| 82 | guide support |
| 84 | access member |
| 86 | slotted members of (84) |
| 88 | frame unit of (82) |
| 90 | support member of (82) |
| 92 | couple slotted members of (82) |
| 94 | slotted space of (92) |
| 77 | antenna (antennae) |

DETAILED DESCRIPTION OF THE PREFERRED EMBODIMENTS OF THE INVENTION

The following description of the preferred embodiments of the concepts and teaching of this present invention is made in reference to the accompanying drawing figures which constitute preselected illustrated examples of the structural and functional elements of the present invention, among many other examples existing within the scope and spirit of the present invention.

Referring now to the drawings, FIGS. 1, 2, 3, 4, 5, 8, 12 and 13; thereof, there is shown a Children's Space Pod Module Assembly 10, of the present invention, referred to herein as the Module 10, or the Module Assembly 10.

The Module 10 is utilized by children or persons in a children's recreational play area, for play, fund and children's recreation in the simulation of a saucer or space pod environment.

The Module Assembly 10 is provided with a saucer enclosure subassembly 12 which is truncate in visual configuration, setting forth part of a saucer or pod space craft as an enclosure, such as, for example, a cut-off or bisected (or sagittally sectioned) cross-section of a flying saucer or space pod configuration; ash shown by example in FIGS. 1, 2, 4, 5, 6, 8, 12 and 13.

The saucer enclosure 12 is provided with the floor segment 14, the roof segment 16, and the curvilinear wall 18, positioned for support between the segments 14 and 16. The floor segment 14 is provided with the inboard surface 20 and the outboard surface 22; the roof segment 16 with its inboard and outboard surfaces 24 and 26; and the wall 18 with the inboard surface 28 and the outboard surface 30. The inboard surfaces 20, 24 and 28, proximally face interior of the saucer enclosure 12.

The wall 18 is provided with the middle portion 32, arcuate or curved in peripheral configuration; and the first and second end portions 34 and 36, respectively. As set forth within the scope and spirit of the present invention, the lengthwise or height dimensions of the first and second end portions 34 and 36 are greater in dimension (longer in height, vertically in reference to a horizontal axis) than the length dimension of the middle portion 32 of the same curvilinear wall 18; or each of the end portions 34 and 36, respectively, is longer in dimension than the length dimension of the middle portion 32; as shown and illustrated by example only in FIGS. 1, 2, 4, 5, 8, 12 and 13. It will be recognized within the scope of the invention that the difference or differences between the height of the middle portion 32 in relation to the height or heights of the end portions 34 and 36 can vary, so that the wall 18 supports the roof segment 16 in an elevated position, from back to front of the enclosure 12, as illustrated by example in FIGS. 8, 12, and 13, and the balance of the drawings. In so doing, a preferable range and ratio of end portion (34, 36) dimension to middle portion (32) dimension, is from about 5.5 to about 0.5, or about or approximately 5.5:0.5. It will be appreciated within the scope of the invention, that this dimensional ratio-relationship can vary, within the scope of setting forth a space saucer or space pod configurational shape, overall, with respect to the enclosure 12.

Figure 4:
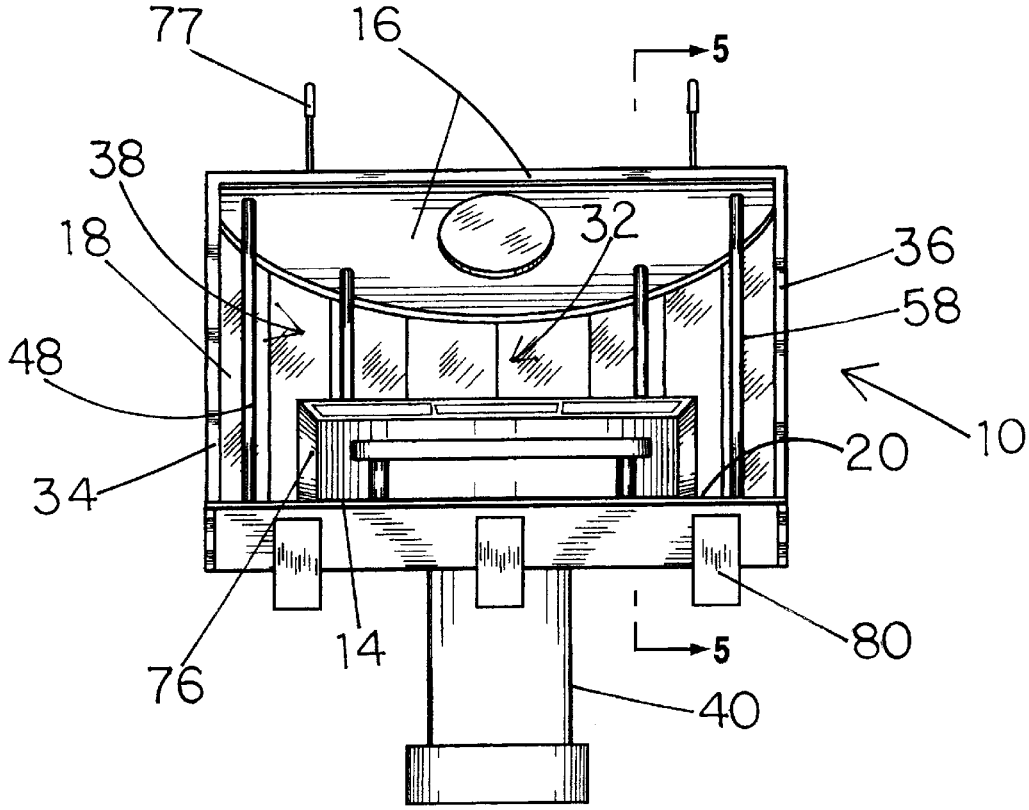
FIG. 4 is a front perspective view of another embodiment of the present invention.
Figure 5:
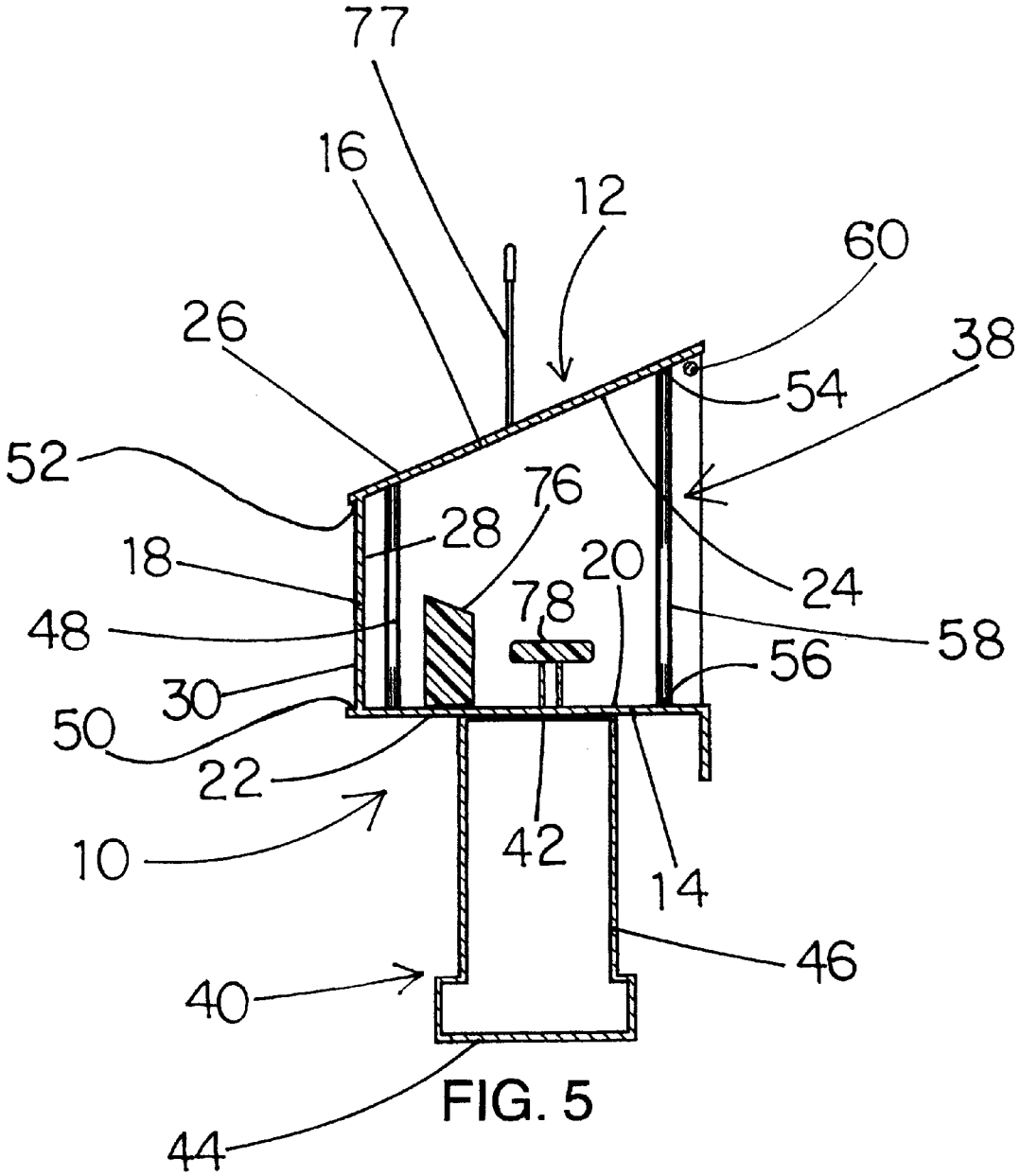
FIG. 5 is a side, cross-sectional view of the invention of FIG. 4, taken alone line 5—5, thereof.
Figure 6:
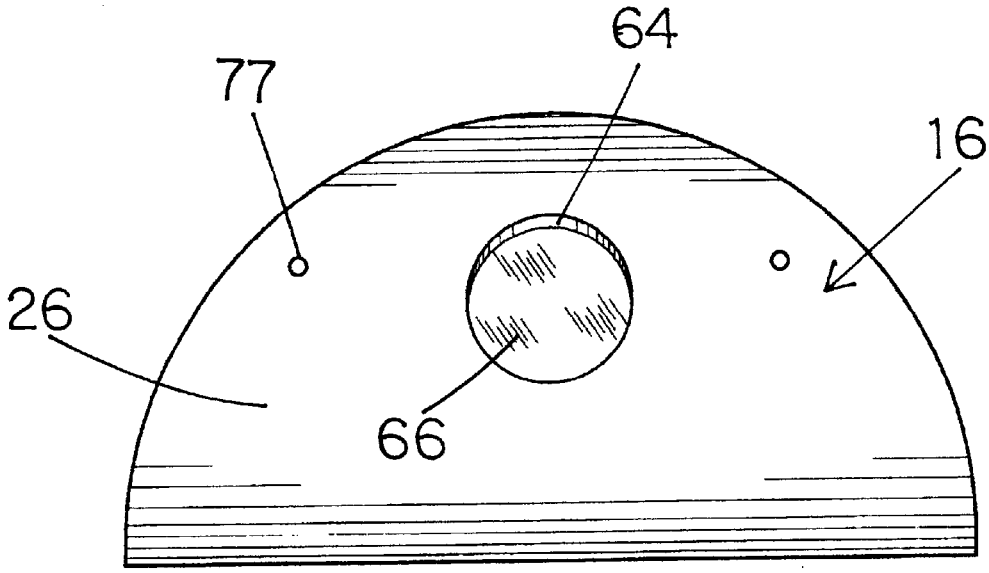
FIG. 6 is a top view of the embodiments of the invention illustrated at FIGS. 1 and 4.
Figure 7:
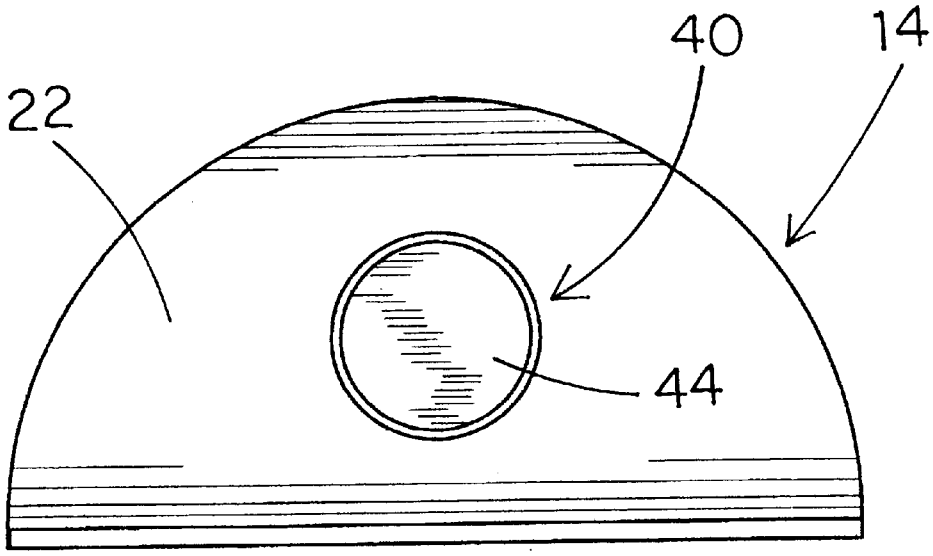
FIG. 7 is a bottom view of the embodiments of the invention illustrated at FIGS. 1 and 4.
Figure 8:
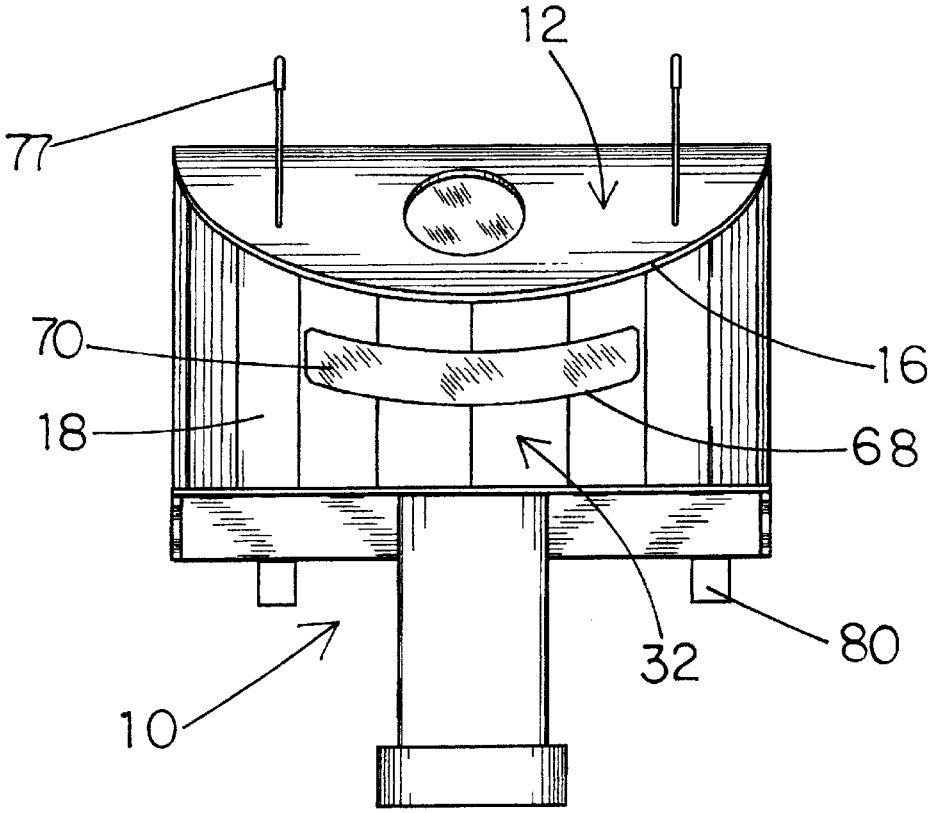
FIG. 8 is a back perspective view of another embodiment of the present invention.

The saucer enclosure 12 is also provided with the play area 38, an interior recreational space provided within the enclosure 12, with its peripheral borders being established or defined by the inboard surfaces 20, 24 and 28, of the floor 14, the roof 16, and the wall 18, respectively; as illustrated generally by example in FIGS. 1, 4, and 5. As illustrated, the play area 38 opens along, at, or proximately at, the first and second end portions 34 and 36, and along the adjacent or neighboring (or proximal) inboard surfaces 20 and 24, located forwardmost, or proximately forwardmost, on the floor and roof segments 14 and 16, respectively.

The Module 10 is further provided, in preferred embodiments of the invention, with the base securement subassembly 40. The base 40, in one preferred embodiment, is provided with its first and second ends 42 and 44, respectively; and the peripheral side wall 46, connecting the ends 42 and 44. The first end 42 is fixedly, securely, integrally or permanently attached to the floor segment 14 for secure support and balance of the saucer enclosure 12; and in preferred embodiments, for elevation thereof. The second end 44 of the base 40 is partially or completely buried and/or securely inserted into the ground (if a grass/dirt land surface); buried, inserted or secured within a portion of another type of surfacing (such as cement, playground surfacing or polymer or other type of surfacing, etc.); or otherwise secured by a diverse variety of means conventionally or otherwise available for securing the base 40, or such types of support structures; and, thereby, securing the Module 10 in a children's recreational area, covered area, enclosure or room.

It will also be recognized within the scope and spirit of the invention that the base securement 40 can be designed in a number of 'support-friendly' shape configurations. One preferred embodiment; illustrated by example only, in FIGS. 1, 2, 3, 4, 5, 7, 8, 9, 12 and 13; sets forth one circumferential or peripheral dimension extending proximally or proximately from the first end 42 of the base 40, and a greater circumferential or peripheral dimension extending proximally from the second end 44 of the base 40. It will be recognized within the scope of the invention that the configuration of the base 40 can be tapered, reverse tapered, uniform, square, multi-sided, and/or triangular, pyramidal or obelisk in shape or configuration, as viewed from one or more angles or directional views.

In preferred embodiments of the invention, as illustrated by example, the saucer enclosure subassembly 12 is provided with a number (or plurality) of support members 48; shown by example in FIGS. 1, 4, and 5, for providing additional support to the roof 16 and/or the floor 14. It will also be recognized within the scope of the invention that the support members 48 can be set forth, structurally, as an integral support member which is solid, ported or fluted (spaces removed therein), opaque and/or transparent to light, or relatedly structured, to provide additional support between the floor 14, the roof 15, and/or the wall 18.

Also, although shown by example, as being positioned inside or interior of the inboard surface 28 of the wall 18; it is also within the scope of the present invention to position the support members 48 proximal or adjacent to the outboard surface 30 of the wall 18, along extended portions 50 and 52 of the floor 14 and the roof 16, respectively.

Additionally, in preferred embodiments, each of the support members 48 is provided with first and second ends 54 and 56, and the peripheral wall 58, therebetween, or connecting its ends 54 and 56, for support as described above and illustrated. By example, the support members 48 are illustrated as cylindrical support members; but it will be understood within the scope of the invention that the support members 48 can be square or linear in configuration, pyramidal or multi-sided and/or planed, or otherwise shaped for the purpose of providing secure support as described.

Also, in preferred embodiments of the Module 10, the saucer enclosure 12 is provided with a curtain rod member 60, extending proximal, or adjacent, to the inboard surface 24 of the roof segment 16, and connecting between the first and second end portions 34 and 36 of the curvilinear wall 18; as illustrated, by example, in FIGS. 1, 3, 4 and 5. Also provided is the curtain member 62, which is mounted or installed on the curtain rod 60 by a number of available or diverse ways; such as, for example, sliding curtain hooks or a flap created from the curtain 62, itself. In this manner, the curtain 62 can be optionably or selectively utilized to privately close off, partially close off, or leave open to access, the play area 38 of the saucer enclosure 12. The curtain 62 is fabricated from a polymer, alloy and/or rubber material(s), and/or weather-proof, resilient or other substances or materials; and can be provided in different solid opaque colors, different transparent or partially transparent colors, or in ported, fluted, or spaced segments of material (s).

In further preferred embodiments of the present invention, the roof segment 16 is provided with a skylight space 64, as illustrated, by example, in FIGS. 1, 2, 4, 6 and 8. In relation thereto, the roof 16 is also provided, in preferred embodiments, with the light transmitting subportion 66. The subportion 66 can be a semi-or-partially transparent, or removable see-through-type window or port cover; or may, in other preferred embodiments, take the form of a light source (AC or DC-powered), or natural or synthetic light-intensity magnifier. The subportion 66 is installed in, or within, the skylight space 64, as illustrated by example; and can also be mounted on the inboard surface 24 of the roof 16, or other portion thereof, without utilizing the space 64, for such purposes, in embodiments of the invention not having the space 64.

Additionally, in preferred embodiments of the invention, the curvilinear wall 18 is provided as, and fabricated of, a substantially transparent material or materials.

In other preferred embodiments of the present invention, the middle portion 32 of the wall 18 is provided with the view space 68. In this regard, preferred embodiments also provide the see-through portion 70 which is installable by a number of means in the view space 68. The portion 70 is illustrated, by example , as a transparent removable window, in FIG. 8.

Figure 9:
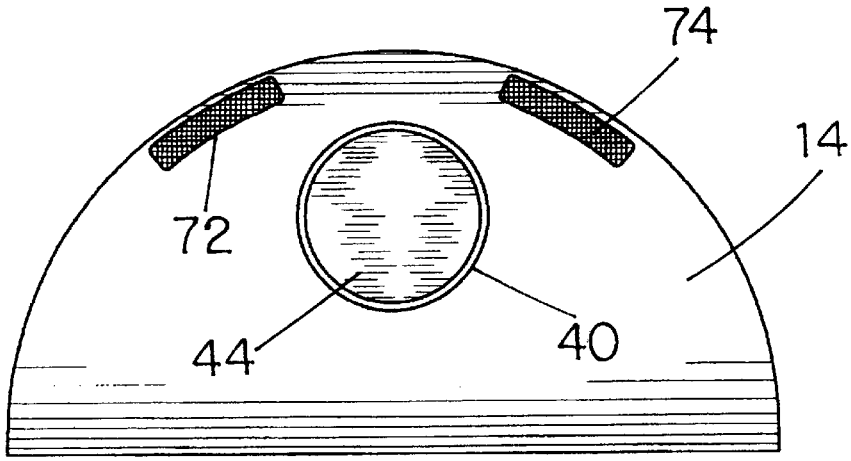
FIG. 9 is a bottom view of another embodiment of the invention.

Also, as illustrated, by example, in FIG. 9, the floor segment 14, in preferred embodiments of the invention, is provided with the air vent spaces 72; and, in this regard can take the form within the scope of the invention, as a number of air-vent grill members 74, each installed within the respective air vent spaces 72, or separately installed. It will be understood, within the scope of the invention, that the air vent spaces 72 can be provided in a number of diverse configurations and positional placements. Additionally, the grill members 74, when utilized in preferred embodiments of the invention, can be removably installed separately, or by utilization of the vent spaces 72; or installed in lieu of such vent spaces 72.

In additional preferred embodiments, the saucer enclosure 12 is provided with the simulating control panel 76 and the seating apparatus 78; as shown, by examples, in FIGS. 1, 4 and 5. The panel 76 and seating 78 are provided within the play area 38, of the saucer enclosure 12 for children's simulation (imagination and/or make-believe) of a saucer or space pod or vehicle (rocket-ship) control panel and/or cockpit. A number of diverse furnishing(s), apparatus and equipment can be utilized as the panel 76 and the seating 78 to bring about this simulation. In this similar regard, in preferred embodiments of the invention, the roof segment 16 is provided with one or more antenna (antennae) members; as illustrated, by example, in FIGS. 1, 2, 3, 4, 5, 6, 8, 12 and 13, at numeral 77.

In additional preferred embodiments, the floor segment 14 of the saucer enclosure 12 is provided with coupling members 80, attached to and extending from the floor 14. Examples of the members 80 are illustrated at FIGS. 1, 2, 3, 4, 8, 12 and 13, as cantilevered members. A number of diverse coupling apparatus are utilizable as the members 80. In preferred related embodiments, the coupling members are provided as cantilevered projections or hook-like structures, which are spaced or placed a space or distance from one another along the front end of the floor 14; and constructed or fabricated from a resilient and semi-to-substantially flexible material such as alloy, laminate, polymer, rubber, ceramic material, or combinations thereof.

In related, preferred embodiments of the present invention the Module 10 is further provided with the guide support 82, for optionable interface or engagement with the coupling members 80, and for optionable engagement or interface with a neighboring support area or structure, such as another playhouse-type structure of like children's recreational equipment or apparatus.

In other preferred embodiments, the Module 10 is provided with the access member 84, or apparatus, for selected or optionable engagement or interface with the coupling members 80, so that a guided (or structurally indicated) entrance or elevated walkway or path to the play area 38 of the enclosure 12 is provided. In preferred embodiments, the access member 84 is provided in the form of an access stairway, as illustrated by example in FIG. 13. In such an embodiment, the access 84 is provided with one or more slotted members 86, for engagement and coupling connection with each of the respective coupling members 80. The access 84 can also be utilized independently of the members 80.

Figure 10:
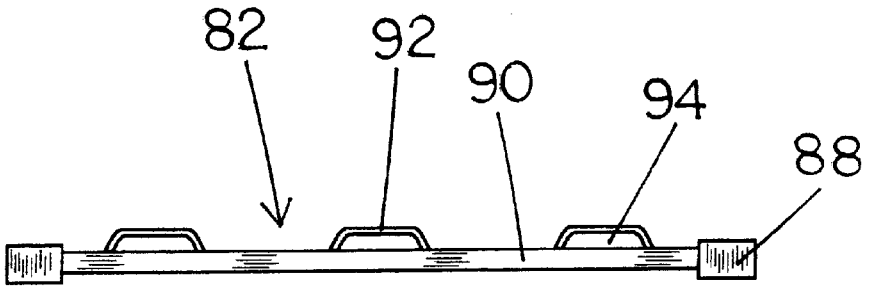
FIG. 10 is a top view of an embodiment of the guide support means of an embodiment of the present invention.
Figure 11:
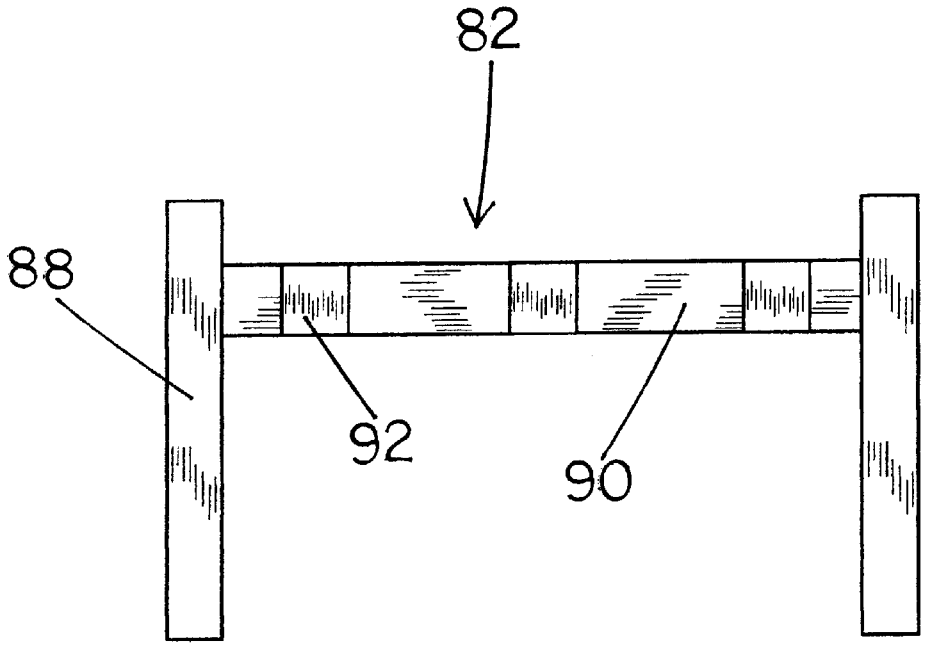
FIG. 11 is a front view of the guide support means illustrated at FIG. 10.
Figure 12:
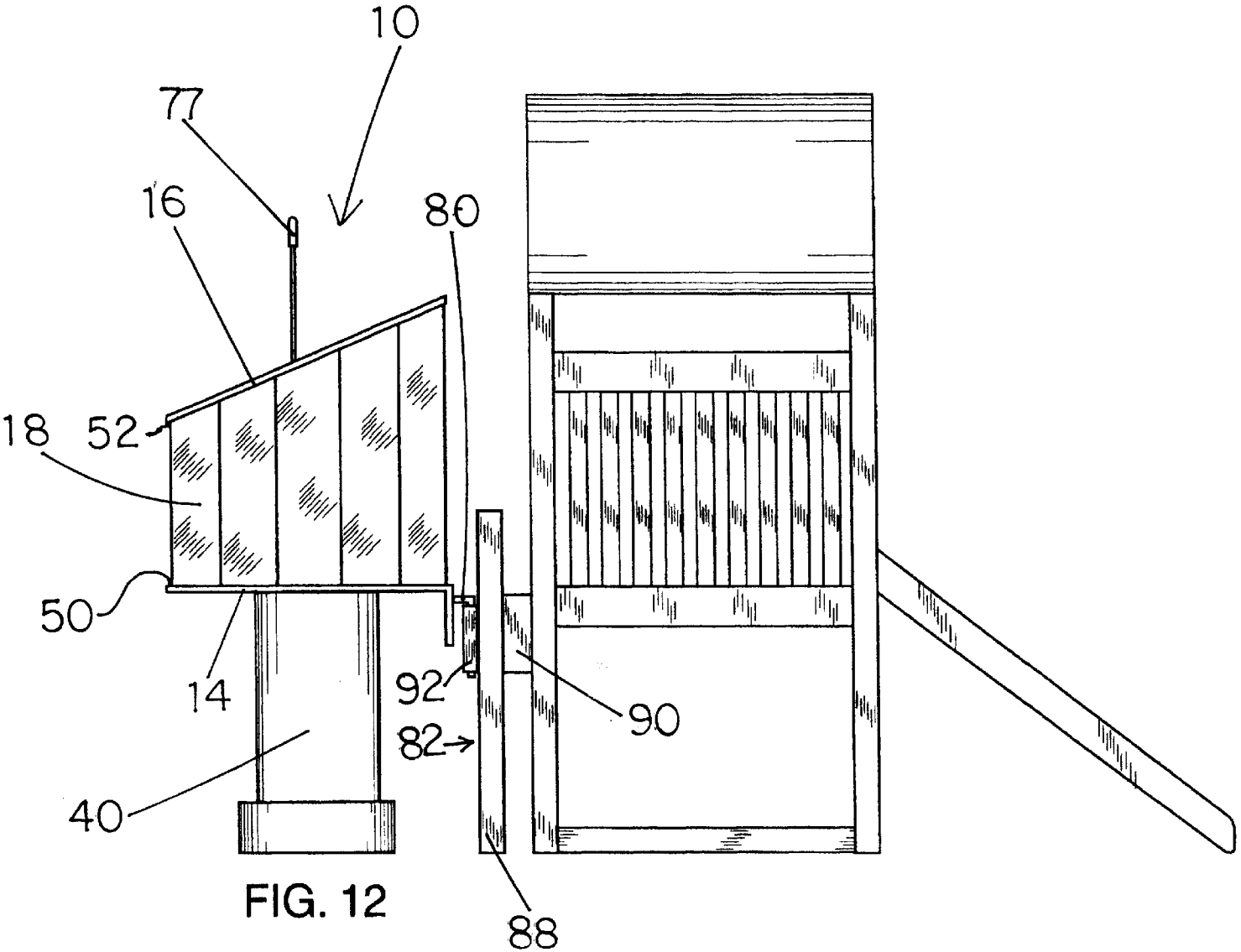
FIG. 12 IS A SIDE VIEW OF AN EMBODIMENT OF THE INVENTION, ILLUSTRATED in interface with a conventional playhouse shown in general detail.
Figure 13:
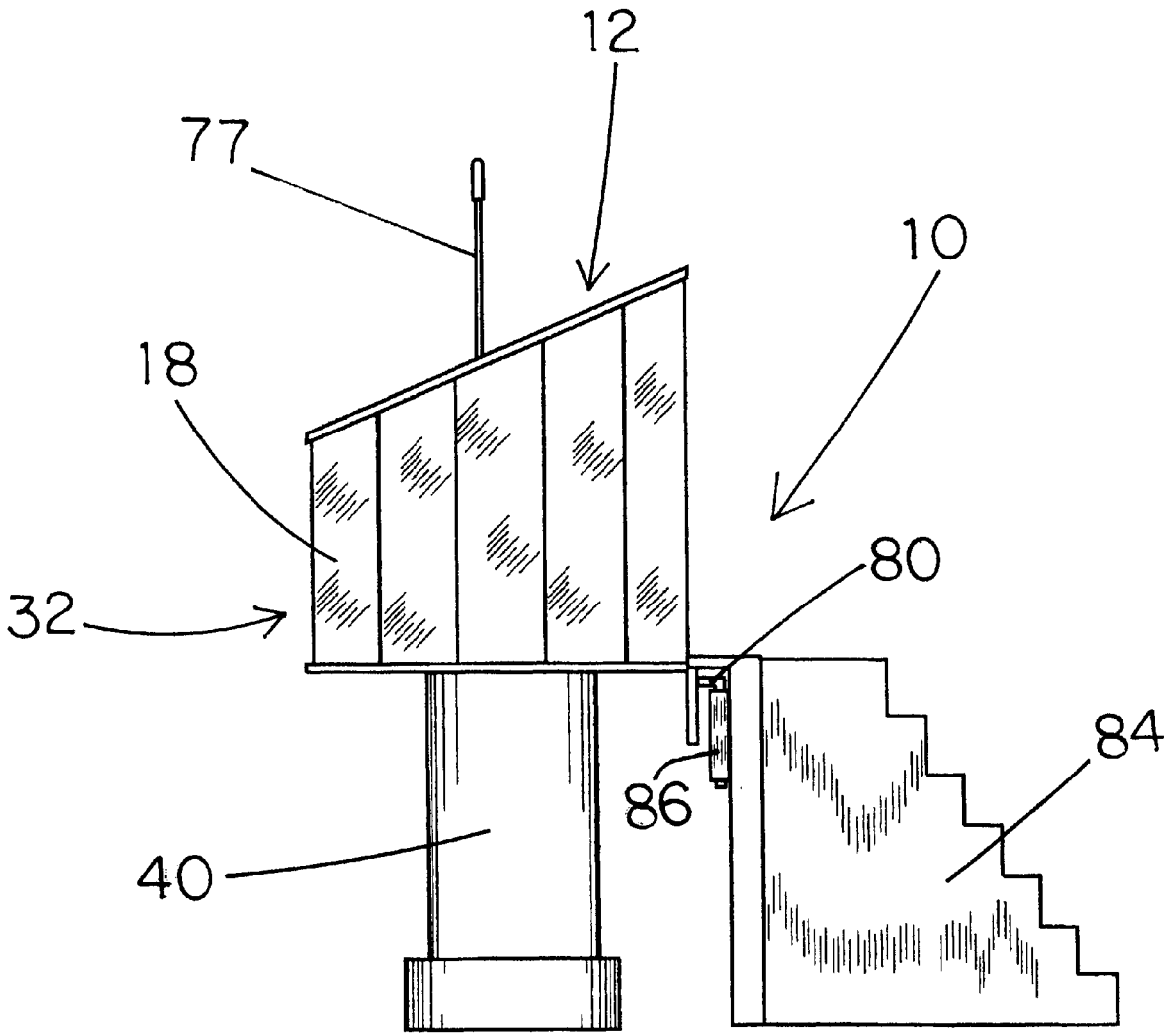
FIG. 13 is a side view of another embodiment of the present invention.

With regard to the guide support 82, as illustrated by example in FIGS. 10, 11 and 12; the support 82 is provided with the frame unit 88, which supports an elevated support member 90. The support 90 is further provided with one or more couple-slotted members 92, for engagement and coupling, or connection, with the coupling members 80 of the floor segment 14 of the enclosure 12. Each of the couple-slotted members 92 is provided with a slotted space 94, or apertured channel, as shown, by example, in FIG. 10. A diverse number and configuration of such slotted spaces 92 can be utilized within the scope and spirit of the present invention, for receipt and registering of each of the coupling members 80. In such a manner, the support member 90 and guide support 82 aids, or respectively aid, in support of the enclosure 12, and interface and access to a neighboring structure, if this is desired, as shown and illustrated, by example, in FIG. 12.

The saucer enclosure 12, the base securement subassembly 40, and the guide support 82 can be fabricated of a number of diverse resilient and secure, weight-bearing materials, including metal, alloys, polymeric materials, laminate materials, wood, resilient rubber, resilient ceramic materials, and/or combinations thereof.

Additionally, the floor segment 14 and the roof segment 15 can, each, be provided in an arcuate or curved, or half-moon-type configuration or shape as illustrated by example in FIGS. 1 through 9. It is also within the scope and spirit, in addition to the examples illustrated and disclosed as preferred embodiments of the invention, to provide each of the segments 14 and 16 in other configurations such as square, rectangular, triangular and in other configurations setting forth linear or substantially linear perimeters; and such that they form truncated shapes or configurations in relation to one another, such as obelisk, pyramidal or other such shapes or truncated or cut-off geometrical configurations of such shapes; in addition to those shown by example as curved, circular or arcuate.

Accordingly, the appended claims are intended to cover all changes, modifications and alternative options and embodiments falling within the true breath, scope and spirit of the present invention. The reader is, therefore, requested to determine the scope of the present invention by the appended claims and their legal equivalents, and not by the examples which have been given.

What is claimed is:

1. A space pod module assembly for use in a children's play-recreational area, said space pod module assembly comprising:

a saucer enclosure subassembly, truncate in configuration, having floor and roof segments and a curvilinear wall therebetween, each, having inboard and outboard surfaces, the curvilinear wall having a middle portion and first and second end portions, each of said first and second end portions being greater in lengthwise dimension than that of the middle portion, said saucer enclosure defining a recreational play area adjacent to the inboard surfaces of the floor segment, the roof segment and the curvilinear wall, and opening at the first and second end portions of the curvilinear wall, the saucer enclosure subassembly further comprising a plurality of support members having first and second ends and a peripheral wall therebetween, each of said support members being positioned and attached between the floor and roof segments, proximate to the inboard surface of the curvilinear wall, such that weight-bearing support is provided to the roof segment, and a curtain rod member and a curtain member, the curtain rod member having first and second ends, either of said first and second ends being attached to the inboard surfaces of the first and second end portions of the curvilinear wall, proximate positionally to the inboard surface of the roof segment, said curtain member being secured and slideably attached to the curtain rod member, such that the curtain member can be positioned along the curtain rod member to cover and partially cover the recreational play area; and a base securement subassembly having first and second ends and a peripheral side wall therebetween, the first end of the base securement member being securely attached to the floor segment of the saucer enclosure subassembly, and the second end being secured in relation to a surface of a children's play-recreational area, such that the saucer enclosure subassembly is safely secure for use thereof.

2. The space pod module assembly of claim 1, wherein:

the roof segment of said saucer enclosure subassembly defines a skylight space between the inboard and outboard surfaces thereof; and wherein:

the roof segment further comprises a substantially transparent subportion, the substantially transparent subportion being securely and removably installed in the skylight space thereof.

3. The space pod module assembly of claim 1, wherein:

the curvilinear wall is substantially transparent in makeup.

4. The space pod module assembly of claim 1, wherein:

the middle portion of the curvilinear wall defines a view space; and wherein:

the curvilinear wall further comprises a see-through portion, the see-through portion being securely and removably installed in the view space thereof.

5. The space pod module assembly of claim 1, the floor segment defines a plurality of air vent spaces.

6. The space pod module assembly of claim 5, wherein:

the floor segment further comprises a plurality of air-vent grill members, each, being securely and removably installed in one of the plurality of air vent spaces.

7. The space pod module assembly of claim 1, wherein:

the saucer enclosure subassembly further comprises control panel and seating means, positioned within the recreational play area thereof, for children's simulation of a saucer and rocket-ship control panel and cockpit.

8. The space pod module assembly of claim 1, wherein:

the saucer enclosure subassembly further comprises at least one antenna member, attached to the roof segment thereof.

9. The space pod module assembly of claim 1, wherein:

the space pod module assembly further comprises:

coupling means, attached to and supported by the floor segment of the saucer enclosure subassembly, for engagement and attachment to a neighboring support area.

10. The space pod module assembly of claim 9, wherein:

the space pod module assembly further comprises:

guide support means for optionable engagement with the coupling means and for optionable interface with a neighboring support area.

11. The space pod module assembly of claim 9, wherein:

the space pod module assembly, further comprises:

access means for optionable engagement with the coupling means, and guided entrance to the recreational play area of the saucer enclosure subassembly.

12. The space pod module assembly of claim 11, wherein:

said access means comprises an elevating stairway member, defining and having a plurality of slotted members for interface and engagement with the coupling means.

13. The spacer pod module assembly of claim 10, wherein:

the coupling means comprises a plurality of cantilevered hooking members, spaced from one another and fabricated from resilient and at least partially flexible material.

14. The space pod module assembly of claim 13, wherein:

the guide support means comprises a frame unit having an elevated support member, and defining and having a plurality of slotted coupling members, attached to and supported by the support member, for engagement with the cantilevered hooking members, the slotted coupling members, each, defining an installation space for receipt and register of each of said cantilevered hooking members.

15. A saucer module assembly for use in a children's recreational area, said saucer module assembly comprising:

a saucer enclosure subassembly, having floor and roof segments and a curvilinear wall therebetween, each, having inboard and outboard surfaces, the curvilinear wall having a middle portion and first and second end portions, said saucer enclosure defining a recreational play area within the inboard surfaces of the floor segment, the roof segment and the curvilinear wall, and opening at the first and second end portions of the curvilinear wall;

coupling means, attached to and supported by the floor segment of the saucer enclosure subassembly, for engagement and supporting attachment to a neighboring support area, said coupling means comprising a plurality of cantilevered hooking members, spaced from one another; and a base subassembly, securely attached to the saucer enclosure.

16. The saucer module assembly of claim 15, wherein:

the saucer module assembly, further comprises:

guide support means for optionable engagement with the coupling means and for optionable interface with a neighboring support area, said guide support means comprising a frame unit having an elevated support member, and defining and having a plurality of slotted coupling members attached to and supported by the support member, for engagement with the coupling means.

17. The saucer module assembly of claim 15, wherein:

each of said floor and roof segments defines a curved configuration having at least one substantially linearly planed side perimeter.

18. The saucer module assembly of claim 15, wherein:

the roof segment of said saucer enclosure subassembly defining a skylight portion between the inboard and outboard surfaces thereof, and the wall defining a substantially transparent portion therein.

19. A space pod module as-assembly of for use in a children's play area, said space pod module assembly comprising:

a saucer enclosure subassembly having floor and roof segments and a wall therebetween, each, having inboard and outboard surfaces, the wall having a middle portion and first and second end portions, said saucer enclosure defining a play area adjacent to the inboard surfaces of the floor segment, the roof segment and the wall, and opening at the first and second end portions of the wall;

a curtain rod member and a curtain member, the curtain rod member being attached to the wall, proximate positionally to the roof segment, said curtain member being secured and slideably attached to the curtain rod member, such that the curtain member can be positioned along the curtain rod member to cover and partially cover the play area; and a base member securely attached to the saucer enclosure subassembly;

and wherein:

the saucer enclosure subassembly is truncate in configuration;

the wall is curvilinear in configuration; and said space pod module assembly further comprises coupling means, attached to and supported by the floor segment of the saucer enclosure subassembly, for engagement and supporting attachment to a neighboring support area, said coupling means comprising a plurality of cantilevered hooking members, spaced from one another.

20. A space module assembly for use in a children's play area, said space module assembly comprising:

a saucer enclosure subassembly having floor and roof segments and a wall therebetween, each, having inboard and outboard surfaces, the wall having a middle portion and first and second end portions, said saucer enclosure defining a play area adjacent to the inboard surfaces of the floor segment, the roof segment and the wall, and opening at the first and second end portions of the wall;

a curtain rod member and a curtain member, the curtain rod member being attached to the wall, proximate positionally to the roof segment, said curtain member being secured and slideably attached to the curtain rod member, such that the curtain member can be positioned along the curtain rod member to cover and partially cover the play area; and a base member securely attached to the saucer enclosure subassembly;

wherein:

said space module assembly further comprises coupling means, said coupling means comprising a plurality of cantilevered hooking members, spaced from one another.

21. A space module assembly for use in a children's play area, said space module assembly comprising:

a saucer enclosure subassembly having floor and roof segments and a wall therebetween, each, having inboard and outboard surfaces, the wall having a middle portion and first and second end portions, said saucer enclosure defining a play area adjacent to the inboard surfaces of the floor segment, the roof segment and the wall, and opening at the first and second end portions of the wall;

a curtain rod member and a curtain member, the curtain rod member being attached to the wall,m proximate positionally to the roof segment, said curtain member being secured and slideably attached to the curtain rod member, such that the curtain member can be positioned along the curtain rod member to cover and partially cover the play area; and a base member securely attached to the saucer enclosure subassembly;

wherein:

the roof segment of the saucer enclosure subassembly defining and having a sky view window between the inboard and outboard surfaces thereof;

the wall defining and having a see-through portion; and the saucer enclosure subassembly further defining and having at least one air circulation space.

* * * * *